United States Patent [19]

Benton et al.

[11] Patent Number: 4,657,788

[45] Date of Patent: Apr. 14, 1987

[54] PROCESS FOR MULTIPLE STAGE AUTODEPOSITION OF ORGANIC COATINGS ONTO METALS

[75] Inventors: Kenneth C. Benton, Macedonia, Ohio; Raymond J. Weinert, Jr., West Chester, Pa.

[73] Assignee: The Standard Oil Company, Cleveland, Ohio

[21] Appl. No.: 846,324

[22] Filed: Mar. 31, 1986

[51] Int. Cl.[4] ..... B05D 1/18; B05D 3/02

[52] U.S. Cl. ..... 427/354; 427/379; 427/435

[58] Field of Search ..... 427/353, 354, 379, 435

[56] References Cited

U.S. PATENT DOCUMENTS

| | | | |
|---|---|---|---|
| 3,585,084 | 6/1971 | Steinbrecher et al. | 148/6.2 |
| 3,592,699 | 7/1971 | Steinbrecher et al. | 148/6.2 |
| 3,647,567 | 3/1972 | Schweri | 148/6.15 R |
| 3,795,546 | 3/1974 | Hall et al. | 148/6.2 |
| 4,030,945 | 6/1977 | Hall et al. | 148/6.2 |
| 4,160,756 | 7/1979 | Nishida et al. | 260/29.6 M |
| 4,186,219 | 1/1980 | Hall | 427/8 |
| 4,186,226 | 1/1980 | Smith | 427/340 |
| 4,238,535 | 12/1980 | Talsma et al. | 427/388.4 |
| 4,242,379 | 12/1980 | Hall et al. | 427/327 |
| 4,243,704 | 1/1981 | Hall et al. | 427/327 |
| 4,329,401 | 5/1982 | Talsma et al. | 428/462 |
| 4,379,875 | 4/1983 | Samuels et al. | 524/104 |
| 4,411,937 | 10/1983 | Nishida et al. | 427/435 |
| 4,562,098 | 12/1985 | Ahmed | 427/379 X |

*Primary Examiner*—Michael R. Lusignan

*Attorney, Agent, or Firm*—Teresan W. Gilbert; Joseph G. Curatolo; Larry W. Evans

[57] ABSTRACT

A multiple stage autodeposition of organic polymer coating compositions deposited onto metal substrates wherein the coating composition's thickness does not increase by more than about 20Δ compared to a single dry coating. The coated metal substrates formed by the process of the instant invention are corrosion resistant.

35 Claims, No Drawings

PROCESS FOR MULTIPLE STAGE AUTODEPOSITION OF ORGANIC COATINGS ONTO METALS

BACKGROUND OF THE INVENTION

The present invention is directed generally to a process for the application of organic polymer coatings to metal substrates. More specifically, the present invention relates to a multiple stage autodeposition of organic polymer coatings on metal substrates wherein the coated substrate as good barrier properties, adhesion, hardness and corrosion resistance.

The use of organic polymers as coatings on metal surfaces has been practiced on a commercial scale for a number of years. One such method is referred to as the electrocoat or electrodeposit process which is either an anodic or cathodic process whereby an electrical current of high potential is passed through the coating system causing the composition to coagulate on the surface of the article being coated. However, this process is disadvantageous in that it employs a high energy input of electricity. Further, it is difficult to coat the edges and corners of complex metal articles employing the electrodeposit process. The anodic electrodeposit process is further disadvantageous in that serious damage to the substrate can result from the oxidation reactions which occur when the substrate is the anode.

The dip coating process is a process in which the metal substrate for coating is immersed in the coating bath for a specified time and baked to cure the coating. This process is superior to the electrodeposition process in its ability to coat corners, edges and complex shapes. The dip coating process, however, is disadvantageous in that the coating on the substrate is thin, thus the coated substrate usually has poor corrosion resistance. Furthermore, due to the thin coating, pinholes readily form providing a pathway to the metal substrate for oxygen, water and various corrosion promoting ions.

The autodeposition method is a process in which an article is immersed in an acidic coating bath composed of organic film-forming material, water, hydrogen ion, oxidizing agent, and an anion and then the article is withdrawn and optionally rinsed in a solution containing chromium to improve the corrosion resistance of the article over the dip coating process. This type of method is disclosed in U.S. Pat. No. 3,585,084 to Steinbrecher et al. This method is disadvantageous in that there are environmental and pollution problems involved in disposing the hazardous chromium containing waste solutions, while corrosion resistance in the absence of the chromium rinse is poor.

Multiple stage autodepositions have been disclosed for increasing the thickness of the coating but not for improving the corrosion resistance without increasing the thickness of the coating. Multiple stage autodepositions for increasing the thickness of the coatings is disadvantageous in that some organic coating materials have poor intercoat adhesion and thus do not readily adhere to themselves causing peeling and poor corrosion resistance.

It is therefore an object of this invention to provide a process for the multiple stage autodeposition of corrosion resistant organic polymer coatings on metal substrates.

It is another object of this invention to provide corrosion resistant organic polymer coatings, by a multiple stage autodeposition process, which are thin, hard, highly adherent and resistant to impact shock.

It is another object of this invention to provide a process for the multiple stage autodeposition of corrosion resistant organic polymer coatings in the absence of a chromium rinse treatment.

These and other objects, together with advantages over known methods shall become apparent from the specification that follows and are accomplished by the invention as hereinafter described and claimed.

SUMMARY OF THE INVENTION

The invention relates to the multiple stage autodeposition of organic polymer coating compositions deposited onto metal substrates to form coated metal substrates that are highly corrosion resistant. The autodeposition process for applying an organic polymer coating composition onto a metal surface comprises immersing the metal substrate in an organic coating composition; withdrawing the coated substrate from the organic coating composition bath; rinsing the coated substrate in water; optionally drying the coating formed thereon; and then repeating the immersing, rinsing and optionally drying steps about 2 to about 10 times, wherein the thickness of the coated substrate does not increase by more than about 20 percent compared to a dried single coating; and finally baking the coated substrate.

The multiple stage autodeposition process of this invention can be used for industrial metal articles where corrosion protection properties are important such as in the automobile industry, appliance industry and machine parts industry and further where coating properties such as adhesion and hardness are important.

DETAILED DESCRIPTION OF THE INVENTION

The invention described herein can be utilized to coat a variety of metal substrates. Typical metal substrates include but are not limited to cold rolled steel, phosphatized steel, tin free steel, zinc phosphate-treated steel, galvanized steel, iron, zinc, tin-plated steel, tin, copper, aluminum, brass and the like. The primary requirement of the substrate is that it produces sufficient ions to coagulate the particular coating composition on the metal substrate when it is immersed in the organic polymer coating composition bath. Autodeposition process is a mild etching of the metal substrate by the coating composition. In particular, the etching produces soluble, multi-valent metal ions, which cause a localized destabilzation of the coating bath in the immediate area of the metal substrate surface resulting in a continuous deposition of the coating composition onto the substrate.

Various factors should be considered in determining whether the metal substrate should or should not be cleaned and the extent of cleaning, prior to contact with the autodeposition coating composition, including, for example the nature of foreign materials, if any, on the metal substrate and the desired quality of the coating. Foreign materials present on the surface of the metal substrate can lead to the formation of non-uniform coatings. Further, the adhesion and corrosion resistant properties of the coating may be adversely affected as a result of the presence of foreign materials on the metal substrate during the immersion steps. Generally, the cleaner the metal surface the better quality of coating can be obtained from the multiple stage autodeposition process. Types of cleaning agents and applications depend on the foreign material present and the metal substrate and are generally known and used in accordance with known technology.

Compositions of coatings are generally well known in the art. Coating compositions which are effective in forming organic coatings are generally prepared in the form of emulsions, dispersions or solutions in an aqueous or organic medium.

It is believed that the present invention will be used most widely in connection with coatings formed from organic polymers in particular, those polymers derived from ethylenically unsaturated compounds. Other organic polymers useful in the instant invention are those that can be obtained in a form suitable for compounding into an aqueous coating bath.

Organic polymers which can be employed in the instant invention are, among others, those derived from ethylenically unsaturated compounds according to the following formula:

$$R_1R_2C{=}CR_3R_4$$

wherein $R_1$, $R_2$ $R_3$ and $R_4$ are each independently selected from:

(1) hydrogen;
(2) $C_1$—30 alkyl;
(3) $-(CH_2)_p-CN$ wherein p is 0–3;
(4) $-(CH_2)_q-OR_5$, wherein q is 0–30 and $R_5$ is hydrogen, $C_1$—30 alkyl, $C_1$—30 cycloalkyl, $C_1$—30 aryl, $C_1$—30 alkylaryl or derivative thereof; and
(5) $-(CH_2)_n-COOR_6$, wherein n is 0–5 and $R_6$ is hydrogen, $C_1$—30 alkyl, $C_1$—30 cycloalkyl, $C_1$—30 aryl, $C_1$—30 alkylaryl or derivative thereof.

Preferably, the olefinically unsaturated compounds comprise compounds wherein $R_1$, $R_2$, $R_3$ and $R_4$ are each independently selected from:

(1) hydrogen;
(2) $C_{1-10}$ alkyl;
(3) $-(CH_2)_p-CN$, wherein p is 0–2; and
(4) $-(CH_2)_q-OR_5$, wherein q is 0–2 and $R_5$ is hydrogen, methyl, ethyl, i-propyl, i-butyl, cyclohexyl, phenyl, or a derivative thereof; and
(5) $-(CH_2)_n-COOR_6$ wherein n is 0–2 and $R_6$ is hydrogen, methyl, ethyl, n-propyl, i-propyl, n-butyl, i-butyl, 2-ethylhexyl, n-octyl, lauryl, stearyl, cyclohexyl, phenyl, hydroxymethyl, 2-hydroxethyl, 2-ethoxyethyl or 2-(N,N-dimethylamino)-ethyl.

Most preferably, the olefinically unsaturated compounds comprise compounds wherein $R_1$, $R_2$, $R_3$ and $R_4$ are each independently selected from hydrogen, methyl, ethyl, $-(CH_2)_p-CN$, wherein p is 0–1, $-(CH_2)_n-COOR_6$ wherein n is 0–1, and mixtures thereof.

Ethylenically unsaturated compounds include but are not limited to derivatives and homologues of acrylic acid, methacrylic acid, acrylic acid esters, methacrylic acid esters, amides, nitriles, vinyl esters, vinyl halides, vinylidene halides, vinyl aromatics, other ethylenically unsaturated compounds and the like.

The acrylic acid esters include derivatives and homologues of methylacrylate, ethylacrylate, propylacrylate, n-butylacrylate, cyclohexylacrylate and the like. Most preferred are methylacrylate and ethylacrylate.

The methacrylic acid esters include derivatives and homologues of methyl methacrylate, ethyl methacrylate, cyclohexyl methacrylate, phenyl methacrylate, n-butyl methacrylate and the like. The most preferred are methyl methacrylate, cyclohexyl methacrylate and phenyl methacrylate.

The amides include derivatives and homologues of acrylamide, N-methyl acrylamide, N,N-dimethylacrylamide, N-butylacrylamide, N-octylacrylamide, methylenebis(acrylamide), N-methylolacrylamide, methacrylamide, N-methylmethacrylamide, N,N-dimethylmethacrylamide, diacetoneacrylamide and the like. Most preferred are N,N-dimethylacrylamide, N-butylacrylamide and N,N-dimethylmethacrylamide.

The nitriles include derivatives and homologues of acrylonitrile, methacrylonitrile, tetracyanoethylene, itaconic acid nitrile, fumaronitrile and the like. Mosst preferred are acrylonitrile and methacrylonitrile.

The vinyl esters include derivatives and homologues of vinyl acetate, vinyl stearate, vinyl butyrate, vinyl propionate and the like. Most preferred is vinyl acetate.

The vinyl halides include derivatives and homologues of vinyl chloride, vinyl bromide, vinyl fluoride and the like. Most preferred is vinyl chloride.

The vinylidene halides include derivatives and homologues of vinylidene chloride, vinylidene fluoride and the like. Most preferred are vinylidene chloride and vinylidene fluoride.

The vinyl aromatics include derivatives and homologues of styrene, alpha-methylstyrene, p-methylstyrene, p-chlorostyrene, vinyl napthalene, o-methylstyrene, o-chlorostyrene, p-t-butylstyrene and the like. Most preferred are styrene and alpha-methyl styrene.

Other ethylenically unsaturated compounds include derivatives and homologues of acrylic acid, methacrylic acid, indene, methylidene, vinylcyclohexane, isobutylene, propylene, maleic acid and its esters, fumaric acid and its esters and the like. Most preferred are acrylic acid, methacrylic acid, indene and isobutylene.

The coating bath is an emulsion, dispersion or solution comprising the coating composition, water, fluoride ions and an oxidant. The water is used as a diluent to dilute the coating composition to a suitable solids content. Typically the solids content of the coating composition are diluted with water to about 5 g/l to about 100 g/l, preferably about 10 g/l to about 50 g/l.

Sources of fluoride ions and procedures to add fluoride ions to the coating bath are generally well-known in the art. Typical sources of fluoride ions include but are not limited to ammonium fluoride, hydrofluoric acid and its solubule or partially soluble salts such as sodium, potassium, cesium, iron (III), tin (II), tin (IV), copper (II) and zinc salts and the like. Ammonium fluoride, hydrofluoric acid and mixtures thereof are the most preferred sources of fluoride ions. Generally, the fluoride ions source is present in the range of about 0.5 g/l to about 10 g/l, preferably about 1.0 g/l to about 4.0 g/l of the coating bath.

Oxidants and the use of oxidants are generally well known in the art. The oxidants may be any oxidizing compound which is solubule in the coating composition bath which include but are not limited to nitric acid, peroxides and peroxydisulfates, and the like. Preferred oxidants are hydrogen peroxides, ammonium, peroxydisulfates and potassium peroxydisulfate and mixtures thereof. The oxidant is present at a concentration of about 0.5 g/l to about 10 g/l, preferably about 1.0 g/l to about 4.0 g/l of the coating bath.

The pH of the coating bath may range from about pH 1.0 to about pH 8.5, preferably from about pH 2 to about pH 6, and most preferably from about pH 2.5 to about pH 4.5. Generally, the procedure to adjust the pH by the additions of acids, buffers and the like to the coating bath is well known in the art. Typical examples of acid additives include but are not limited to hydrochloric acid, hydrobromic acid, sulfuric acid, formic acid, acetic acid, oxalic acid, malonic acid and the like. Typical examples of buffering agents include but are not limited to sodium acetate, potassium tartrate and the like.

It will be readily apparent to those skilled in the art that the coating bath may be further modified by the addition of surfactants, chelating agents, plasticizers, pigments, thickners and the like. The coating bath may also optionally contain modifiers that enhance the stability of the coating bath, modify the coating bath rheology and/or provide special properties to the final coating. All these additives and the use thereof are well known in the art and do not require extensive discussion, it being understood that any additive employed can be used so long as they do not deleteriously affect the coating bath and do not adversely affect the characteristics of the coating.

The metal substrate is immersed in a coating bath that has an operating temperature between about 15° C. to about 50° C., preferably about 20° C. to about 45° C. The bath temperature is kept relatively constant. Any suitable means can be used to contact the coating bath with a heat exchange medium. For example, tubes through which water are circulated can be immersed in the composition or the bath container holding the composition can be jacketed with tubes through which an appropriate heat exchange material is pumped.

The coating composition is contacted with the metal substrate by immersing the metal substrate in the coating bath. The metal substrate is immersed in the coating bath for a period of time within the range of about 5 seconds to about 10 min., preferably from about 10 sec. to about 120 sec.

Agitating the coating composition in the bath while immersing the metal substrate aids in maintaining the uniformity of the coating formed. This may be accomplished, for example, by stirring the composition with a mixer, by moving the substrate in the coating bath and the like.

After withdrawing the coated metal substrate from the coating bath, the coating is rinsed with water for about 5 seconds to about 60 seconds.

Following the water rinse step the coating can optionally be dried at temperatures in the range of about 20° C. to about 260° C., preferably 22° C. to about 200° C.

The metal substrate is then reimmersed in the coating bath for about 5 seconds to about 10 minutes, preferably 10 seconds to 120 seconds. The different immersion steps may all be the same length of time or different lengths of time. The cycle of immersion, rinsing with water and optionally drying is repeated about 2 to about 10 times, preferably about 3 to about 7 times and most preferably from about 4 to about 5 times. The thickness of the coated metal substrate does not increase by the cyclic process more than about 20 percent compared to a dried single coat.

The final step after the immersion, rinse and optionally dry cycles is baking the coated metal substrate. The metal substrate is baked to cure the coating on the metal substrate at a temperature from about 100° C. to about 260° C., preferably from about 180° C. to about 230° C.

Generally the coated metal substrate has a coating thickness of from about 0.05 mil to about 5 mil, preferably from about 0.1 mil to about 2 mil. The thickness of the coated substrate dos not increase in thickness by more than 20 percent compared to a dried single coating. It is theorized that the coating does not increase in thickness by more than 20 percent of a single dry coating because of the interval rinsing steps and/or drying steps. During the rinsing steps the coating is washed substantially free of the metal ions and during the drying steps the free water contained in the coating which is a transport medium for the metal ions is removed. Thus, through rinsing and/or drying the metal ions from the substrate through the coating are greatly reduced. Therefore, reimmersion of the metal substrate in the coating bath results in preferential deposition of the coating composition to the areas where the coating bath has access to the metal substrate which liberate ions, such as pinholes, defects, pores and thin areas of the first coating layer. Accordingly, there is no more than about 120 percent the thickness of a dry single immersion coating in the subsequent stages of the autodeposition process of the instant invention.

It has been observed that the metal substrates coated according to the process of this invention have outstanding qualities with respect to corrosion resistance and adhesion.

SPECIFIC EMBODIMENTS

The outstanding results that can be obtained from the utilization of the present invention will become apparent from the examples set forth hereinafter.

PREPARATION OF ORGANIC COATING COMPOSITION

A clean dry, 7 oz. crown cap bottle was charged with about 0.62 g of Gafac RE-610 (surfactant, available from GAF Corp. New York, N.Y.) and about 65 g of water. This solution was agitated by magnetic stirrer to dissolve the surfactant. About 15.08 g of a 70/30 butadiene/acrylonitrile copolymer elastomer emulsion of 27.8 percent solids was diluted with about 18.18 g of water. The diluted elastomer emulsion was added dropwise to the rapidly agitated surfactant solution. About 0.61 g of pentaerythritol tetra(3-mercaptopropinate) was dissolved in a mixture of about 30 g of acrylonitrile and about 10 g of methylacrylate resulting in a monomer/chain transfer agent solution, which solution was added to the reaction bottle.

The reaction bottle was sealed with a rubber lined, perforated crown cap. The bottle was purged for about 10 minutes with nitrogen by means of about a 12 inch hypodermic needle inserted through the cap and with an inserted shorter needle as a vent. A nominal 5 psig nitrogen pressure was left in the reaction bottle after the nitrogen purge. The reaction bottle was then placed in a safety cage.

A solution of about 0.055 g of potassium persulfate in about 9.6 ml of water was prepared and about 4.8 ml of this initiator solution was injected by a syringe into the reaction bottle. The reaction bottle was then rotated in about a 56° C. constant temperature water bath for about 6.25 hours. The resulting latex was filtered through a double layer of cheezecloth to remove the coagulum.

The latex product contained about 29.8 percent solids and exhibited the following characteristics; 3.7 pH, 2140 Å average particle size, 78 wt percent acrylonitrile content, $1.69\times10^5$ weight average molecular weight and 4.5 Mw/Mn (polydispersity index). This latex was used in the organic polymer coating composition.

COATING COMPOSITION BATH FORMULATION

About 75 g of the latex was added to approximately 1 liter of distilled water. About 10 ml of 30 percent aqueous hydrogen peroxide and about
3 g of 50 percent aqueous hydrofluoric acid were added to the diluted latex with agitation to form the autodeposition coating bath. The coating bath had a pH of about 3.46.

TEST PANELS

The coating compositions were coated onto the following two types of 4 inch × 6 inch 20 gauge test panels;

Q-panels which are polished, cold rolled steel from Q-Panel Co., Cleveland, Ohio, and B-40 panels which are cold rolled zinc phosphate pretreated steel panels from Parker Co., Detroit, Mich.

The test panels were washed with acetone and dried prior to being employed.

TEST METHOD

Test panels 1 and 2, respectively, a Q panel and a B-40 panel, were immersed in the coating composition bath for about 10 seconds, withdrawn from the bath, rinsed with water for about 10 seconds, and air dried. The process was repeated with immersion time, respectively, of about 30, about 60, about 90 and about 110 seconds. After the final coat was deposited, the panels were rinsed with water and baked for about 10 minutes at about 200° C. The test results are shown in Table I.

Test panels 3 and 4, a Q panel and a B-40 panel, respectively, were immersed in the coating composition bath for about 10 seconds, withdrawn from the bath, rinsed with water for about 10 seconds, and baked for about 10 minutes at about 200° C. The process was repeated with the immersion time of the coats, respectively, at about 30, about 60, about 90 and about 110 seconds. The test results are shown in Table I.

B-40 test panels 5,6,7 and 8 were immersed in the coating composition bath, rinsed with water and air dried after each coating application. The process was repeated with the immersion time of the cycles respectively, as follows: example 5, about 10, about 30 and about 60 seconds; example 6, about 10, about 30, about 60 and about 90 seconds; example 7, about 10, about 30, about 200, about 90 and about 110 seconds; and example 8, about 10, about 30, about 60, about 90 and about 110. After the final coat was deposited on the test panels in examples 5–8 were baked for about 10 minutes at about 200° C. The test results are shown in Table II.

Comparative examples 9 Q panel, 10 Q panel and 11 B-40 panel, were immersed in the coating composition bath for, respectively 1 minute, 3 minutes and 3 minutes, and then baked for about 10 minutes at 200° C. The comparative results are shown in Table I.

Comparative example 12, B-40 test panel was immersed in the coating composition bath for about 180 seconds, withdrawn from the bath, rinsed with water for about 10 seconds, air dried and then baked for about 10 minutes to about 200° C. The comparative results are shown in Table II.

In each case, ASTM standard adhesion (tape test), hardness (pencil), reversed impact, creepback and salt fog (rust) testing of the coated metal substrate was carried out.

The thicknesses of the cured dry coatings are nondestructively measured by an electronic probe based on magnetic conduction and eddy current.

The adhesion tape test (ASTM D 3359-78) was carried out by applying a strip of standard tape to a cross-cut section in the coated substrate, previously made by a sharp tool in the coated substrate. The tape was then removed by briskly snapping it off. The adhesion is denoted as the percent of the cross-cut squares of which the coating remains intact.

The hardness test measures the rigidity of the organic coating applied to rigid substrates such as metal panels. The hardness test, (ASTM D 3363-74) was carried out by forcing pencil leads of increasing hardness values against the coated surface in a precisely defined manner, until one lead mars the surface. Surface hardness is defined by the hardest pencil lead which just fails to mar the coated surface. Test ranges are 6B, 4B, 2B, HB, 2H, 4H, 6H and 8H with 8H being excellent, that is, the hardest lead failed to mar the coating.

The impact (ASMT D 2794-82) test measures the tendency for a coating to crack after being deformed by an impacting force. A falling stainless steel dart ball weight hits a panel with the coated side down for the reverse impact test. The height of the fall in inches multiplied by the dropping weight in pounds is the impact energy. To pass the test, a standard tape is applied to the impact area and snapped off and the coating must remain intact.

Examples 1–8 and comparative examples 9–12 were applied to duplicate panels and tested as described above. The duplicate panels were subjected to salt exposure (ASTM B 117) testing. Salt fog testing was carried out by masking with black tape coated portions of the panel and then a large X is scribed in the dried coated panel. The panel is placed in a salt-fog cabinet for a given period of time. The coating compositions were exposed to at least 24 hours of salt fog environment. A rating is given based on the degree of rusting of the samples. Test ranges are 0 to 10, with a 0 rating for all rust and a 10 rating for no appreciable rust; furthermore, the scale is logarthmic between the two extreme endpoints.

Creepback (ASTM-0-1654) was also measured on the test panels subjected to salt exposure testing. Creepback determines the wet adhesion of the coating by measuring in millimeters (mm) how wide the large X mark originally scribed in the test panel has grown after exposure to the salt fog cabinet. The number identified is the number of millimeters the mark has grown with 0 meaning no creepback.

The test results reported in Table I demonstrate multiple stage autodeposited coatings have excellent corrosion resistance at 24 hours and very good corrosion resistance at 100 hours whereas the comparative coating produced by the single dip process have very poor results to failure at 24 hours of salt fog exposure.

The results of the hardness and adhesion tests demonstrate that the multiple stage auto deposition coatings are as good as the single dip coatings. The results of the reverse impact test demonstrates that coatings prepared by Applicant's multiple stage autodeposition process are as good as, or better than, the coatings prepared by the single dip process.

The test results reported in Table II demonstrate that a multiple stage autodeposited coating has superior hardness, adhesion, reverse impact and corrosion resistance than a coating prepared by a single dip process.

Although the invention has been described in detail through the preceeding examples, these examples are for the purpose of illustration only, and it is understood that variations and modifications can be made by one skilled in the art without departing from the spirit and the scope of the invention.

TABLE I

Multiple vs. Single Autodeposited Coatings

| Example | Coating Thickness (mil) | Hardness | Adhesion Percent | Reverse Impact (in-lbs) | Rust Rating 24 hrs. | Rust Rating 100 hrs. | Rust Rating 200 hrs. |
|---|---|---|---|---|---|---|---|
| 1 | 3.1 | 4B | 80 | 0 | 4 | 3 | — |
| 2 | 0.6 | 2H | 0 | 0 | 9 | 7 | 7 |
| 3 | 0.6 | HB | 100 | 0 | 8 | 2 | — |
| 4 | Unknown* | 2H | 100 | 160 | 9 | 5 | — |
| C9 | 0.4 | 4H | 0 | 0 | 0 | | |
| C10 | 0.3 | 2H | 100 | 20 | 1 | | |
| C11 | 0.6 | 2H | 100 | 60 | 0 | | |

*The coating thickness was difficult to measure due to the porous nature of the metal substrate surface.

TABLE II

Effect of Number of Autodeposition Stages

| Example | Number of Autodeposition Cycles | Hardness | Adhesion Percent | Reverse Impact (in-lbs) | Rust Rating 24 hrs. | Rust Rating 100 hrs. | Creep Back 24 hrs. | Creep Back 100 hrs. |
|---|---|---|---|---|---|---|---|---|
| 5 | 3 | 4H | 100 | 140 | 2 | 1 | 0 | — |
| 6 | 4 | 4H | 100 | 60 | 9 | 6 | 0 | 0 |
| 7 | 5 | 8H | 100 | 60 | 6 | 5 | 0 | 0 |
| 8 | 5 | 8H | 100 | 50 | 8 | 6 | 0.2 | 0 |
| C12 | 1 | * | * | * | 0 | 0 | 0 | 0 |

*Coating was too poor for meaningful evaluation.

We claim:

1. A process for applying a polymeric coating to a metal surface comprising:
   (a) immersing a metal substrate in an organic coating composition bath,
   (b) withdrawing the film coated metal substrate from the organic coating composition bath,
   (c) rinsing the film,
   (d) repeating the cycle of immersing and rinsing two to ten times, and
   (e) curing the coated metal substrate.

2. The process of claim 1 wherein after rinsing the coated metal substrate in water, the coating formed thereon is dried prior to repeating the cycle of immersing, rinsing and drying two to ten times.

3. The process of claim 1 wherein after repeating the cycle of immersing and rinsing two to ten times, the coated metal substrate does not increase its thickness by more than 20 percent compared to a single dried coating.

4. The process of claim 2 wherein after repeating the cycle of immersing, rinsing and drying two to ten times, the coated metal substrate does not increase its thickness by more than 20 percent compared to a single dry coating.

5. The process of claim 1 wherein the metallic substrate is selected from the group consisting of cold rolled steel, phosphatized steel, sand blasted steel, tin free steel, zinc phosphate steel, galvanized steel, iron, zinc, tin-plated steel, tin, copper, aluminum and brass.

6. The process of claim 1 wherein the coating polymer is derived from vinyl monomers selected from the group consisting of acrylic acid, methacrylic acid, acrylic acid esters, methacrylic acid esters, vinyl amides, nitriles, vinyl esters, vinyl ethers, vinyl halides, vinylidene halides, vinyl aromatic compounds, other ethylenically unsaturated compounds and combinations thereof.

7. The process of claim 6 wherein the acrylic acid ester is selected from the group consisting of methylacrylate, ethylacrylate, propylacrylate, n-butylacrylate, cyclohexylacrylate and combinations thereof.

8. The process of claim 6 wherein the methacrylic acid ester is selected from the group consisting of methyl methacrylate, ethyl methacrylate, cyclohexyl methacrylate, phenyl methacrylate, n-butyl methacrylate and combinations thereof.

9. The process in claim 6 wherein the vinyl amide is selected from the group consisting of acrylamide, N-methyl acrylamide, N,N-dimethylacrylamide, N-butylacrylamide, N-octylacrylamide, methylenebis(acrylamide), methacrylamide, N-methylmethacrylamide, N,N-dimethylmethacrylamide, diacetoneacrylamide and combinations thereof.

10. The process of claim 6 wherein the nitrile is selected from the group consisting of acrylonitrile, methacrylonitrile, itaconic acid nitrile, fumaronitrile, 1,1-dicyanoethylene and combinations thereof.

11. The process of claim 6 wherein the vinyl ester is selected from the group consisting of vinyl acetate, vinyl stearate, vinyl butyrate, vinyl propionate and combinations thereof.

12. The process of claim 6 wherein the vinyl ether is selected from the group consisting of methyl vinyl ether, ethyl vinyl ether, i-propyl vinyl ether, i-butyl vinyl ether, 2-chloroethyl vinyl ether and combinations thereof.

13. The process of claim 6 wherein the vinyl halide is selected from the group consisting of vinyl chloride, vinyl bromide, vinyl fluoride and combinations thereof.

14. The process of claim 6 wherein the vinylidene halide is selected from the group consisting of vinylidene chloride, vinyladene fluoride and combinations thereof.

15. The process of claim 6 wherein the vinyl aromatic compound is selected from the group consisting of styrene, alpha-methylstyrene, p-methylstyrene, p-chlorostyrene, vinyl napthalene, o-methylstyrene, o-chlorostyrene, p-t-butylstyrene and combinations thereof.

16. The process of claim 6 wherein the ethylenically unsaturated compound is selected from the groups consisting of maleic acid anhydride, fumaric acid, maleic acid esters, fumaric acid esters, allylacrylate, allyl acetate, diallylphthalates, indene, methylindene, vinylcyclohexane, isobutylene, propylene, ethylene and combinations thereof.

17. The process of claim 1 wherein the coating composition bath has an operating temperature between about 15° C. to about 50° C.

18. The process of claim 1 wherein the coating composition bath has an operating temperature between about 20° C. and about 45° C.

19. The process of claim 1 wherein the metal substrate is immersed in the coating composition bath for about 5 seconds to about 10 minutes.

20. The process of claim 1 wherein the metal substrate is immersed in the coating composition bath for about 10 seconds to about 120 seconds.

21. The process of claim 1 wherein the coated metal substrate is rinsed in water for about 5 seconds to about 60 seconds.

22. The process of claim 2 wherein the coated metal substrate is dried at about 20° C. to about 260° C.

23. The process of claim 2 wherein the coated metal substrate is dried from about 22° C. to about 200° C.

24. The process of claim 1 wherein the duration of each immersion step is substantially identical.

25. The process of claim 1 wherein the duration of each immersion step is not substantially identical.

26. The process of claim 1 wherein the cycle of immersing and rinsing is repeated about 3 to about 7 times.

27. The process of claim 1 wherein the cycle of immersing and rinsing is repeated about 4 to about 5 times.

28. The process of claim 2 wherein the cycle of immersing, rinsing and drying is about 3 to about 7 times.

29. The process of claim 2 wherein the cycle of immersing, rinsing and drying is about 4 to about 5 times.

30. The process of claim 1 wherein the polymer coating is cured by baking at about 100° C. to about 200° C.

31. The process of claim 1 wherein the polymer coating is cured by baking at about 180° C. to about 230° C.

32. The process of claim 1 wherein the polymer coating is from about 0.05 to about 5 mil. thick.

33. The process of claim 1 wherein the polymer coating is from about 0.1 mil. to about 2 mil. thick.

34. A process for the autodeposition of a polymeric coating onto a metal substrate comprising:

(a) immersing a metal substrate in an organic coating composition bath, capable of abstracting metal ions from said metal surface, comprising a curable film forming polymer which coagulates in the presence of said metal ions to deposit upon the immersed surface to form an organic coating, (b) withdrawing the coated metal surface from the bath, (c) rinsing the organic coating, (d) repeating steps (a) through (c) up to 10 times, and (e) curing the coating.

35. A process for the autodeposition of a polymeric coating onto a metal substrate comprising:

(a) immersing a metal substrate in a coating bath comprising a polymer derived from ethylenically unsaturated compounds, about 5 g/l to about 100 g/l of water, fluoride ions, about 5 g/l to about 10 g/l of an oxidant at a pH from about 1.0 to about 8.5, at a bath temperature of about 15° C. to about 50° C. for at least about 10 seconds, (b) withdrawing the coated metal substrate from the bath, (c) rinsing the organic coating, (d) repeating steps (a) through (c) up to about 10 times such that after drying the thickness of said coating is no more than about 120% the thickness of a dry single immersion coating, (e) curing the coating.

* * * * *